US008313210B2

(12) United States Patent
Zheng

(10) Patent No.: US 8,313,210 B2
(45) Date of Patent: Nov. 20, 2012

(54) SOLAR-POWERED LED INDICATOR LAMP

(75) Inventor: Shi-Song Zheng, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 407 days.

(21) Appl. No.: 12/712,213

(22) Filed: Feb. 25, 2010

(65) Prior Publication Data

US 2011/0096536 A1 Apr. 28, 2011

(30) Foreign Application Priority Data

Oct. 27, 2009 (CN) ..... 2009 1 0308903

(51) Int. Cl.
*F21L 4/00* (2006.01)

(52) U.S. Cl. ..... 362/183; 362/559; 362/812; 362/600

(58) Field of Classification Search ..... 362/183, 362/559, 565, 576, 577, 145, 152, 153, 153.1, 362/600, 602, 604–607, 812
See application file for complete search history.

(56) References Cited

U.S. PATENT DOCUMENTS

| | | | | |
|---|---|---|---|---|
| 4,611,265 | A * | 9/1986 | Davis | 362/145 |
| 7,585,085 | B1 * | 9/2009 | Holman | 362/183 |
| 2005/0076551 | A1 * | 4/2005 | Silverstone et al. | 40/568 |
| 2007/0193088 | A1 * | 8/2007 | Lemberger et al. | 40/544 |

* cited by examiner

*Primary Examiner* — Danielle Allen
(74) *Attorney, Agent, or Firm* — Altis Law Group, Inc.

(57) ABSTRACT

An LED indicator lamp includes a shell, at least an LED module, a driving and controlling circuit board, a rechargeable battery and a plurality of solar panels. The shell has indicating words formed thereon. The shell and indicating words have different hues so that the indicating words can be easily recognized. The LED module is received in the shell to lighten the shell and highlight the indicating words. The driving and controlling circuit board is received in the shell to drive and control the LED module to lighten. The rechargeable battery is received in the shell to provide the LED module with electrical power. The solar panels are fixed on an outer surface of the shell to capture sunlight and convert it to electrical power to charge the rechargeable battery.

17 Claims, 5 Drawing Sheets

SOLAR-POWERED LED INDICATOR LAMP

BACKGROUND

1. Technical Field

The present disclosure relates generally to an indicator lamp, and more particularly to an LED indicator lamp which is powered by solar energy.

2. Description of Related Art

Visual indicators, for example, emergency exit signs, traffic signs and traffic lights, have long been used for calling attention to particular items. These indicators have light emitting devices incorporated therein which can reliably emit light of different colors, for example, blue, red, yellow, green or any desired color to indicate what needs attention The light emitting devices require power in order to emit the light. However, the indicator may be located very remotely, resulting in that to provide the indicator with electrical power from the power line is expensive or even impossible. A solar-powered indicator can resolve such a problem.

What is need therefore is an LED indicator lamp which is suitable to be located in a remote area and powered by solar energy.

DETAILED DESCRIPTION

Figure 1:
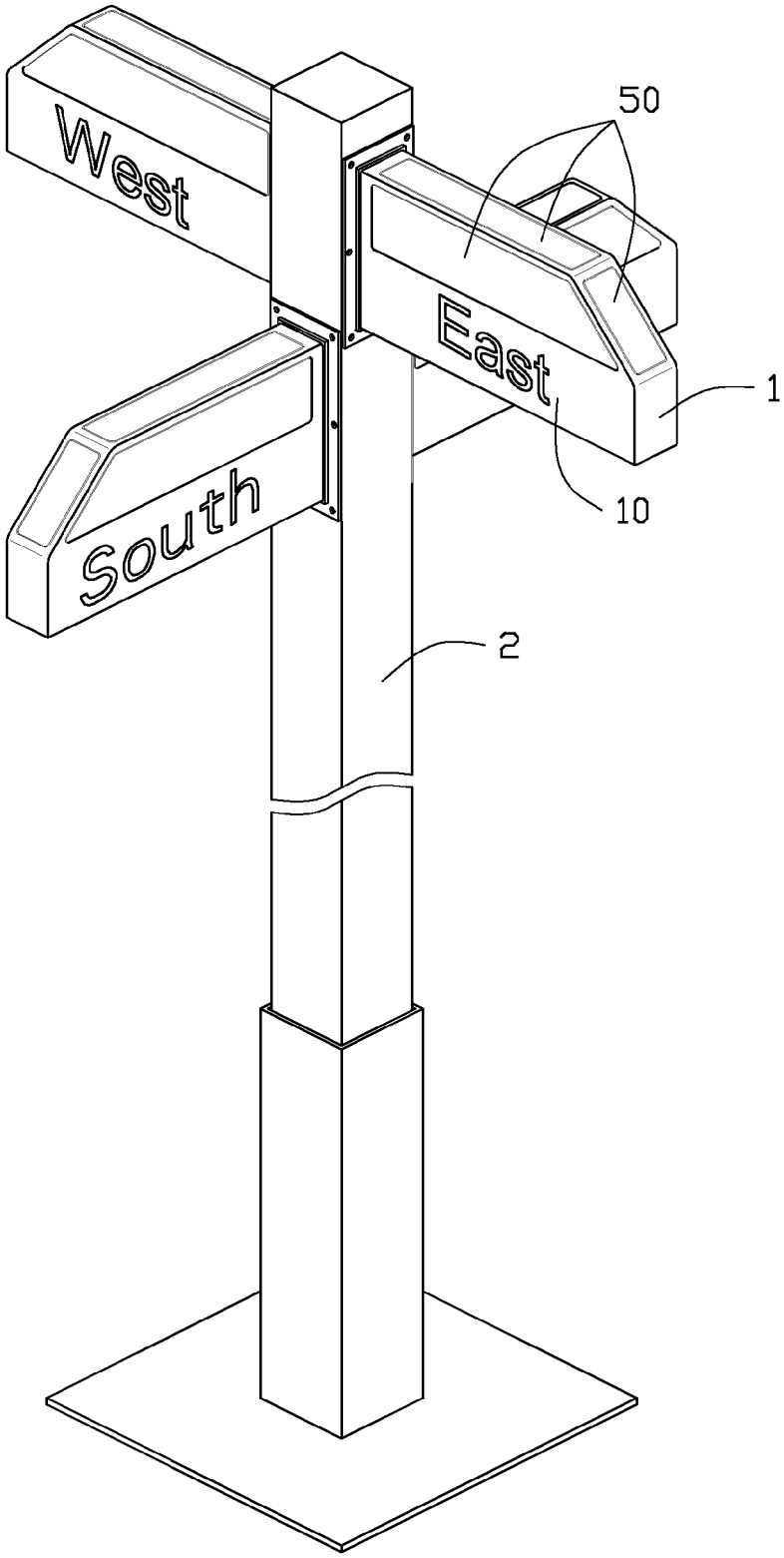
FIG. 1 is an isometric, assembled view of LED indicator lamps assembled to a lamp pole in accordance with an embodiment of the present disclosure.

FIG. 1 illustrates a plurality of LED indicator lamps 1 in accordance with an embodiment of the present disclosure. The LED indicator lamps 1 are fixed to a lamp pole 2, for providing guidance and instruction for motorists and tourists. The LED indicator lamps 1 are fixed to different sides of the lamp pole 2 and directed to different directions, such as east, south, west, north etc.

Figure 2:
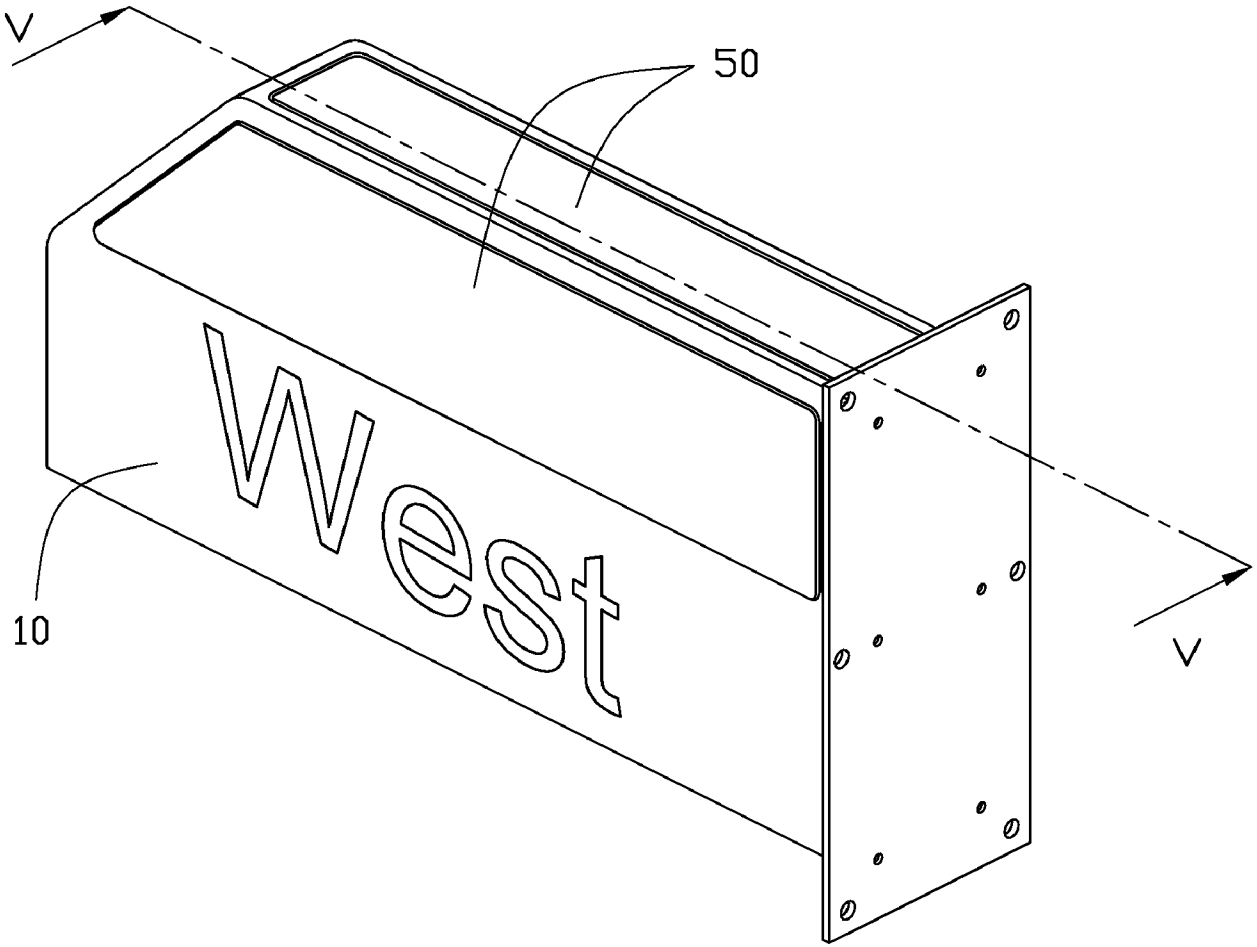
FIG. 2 is an enlarged view of one of the LED indicator lamps of FIG. 1.
Figure 3:
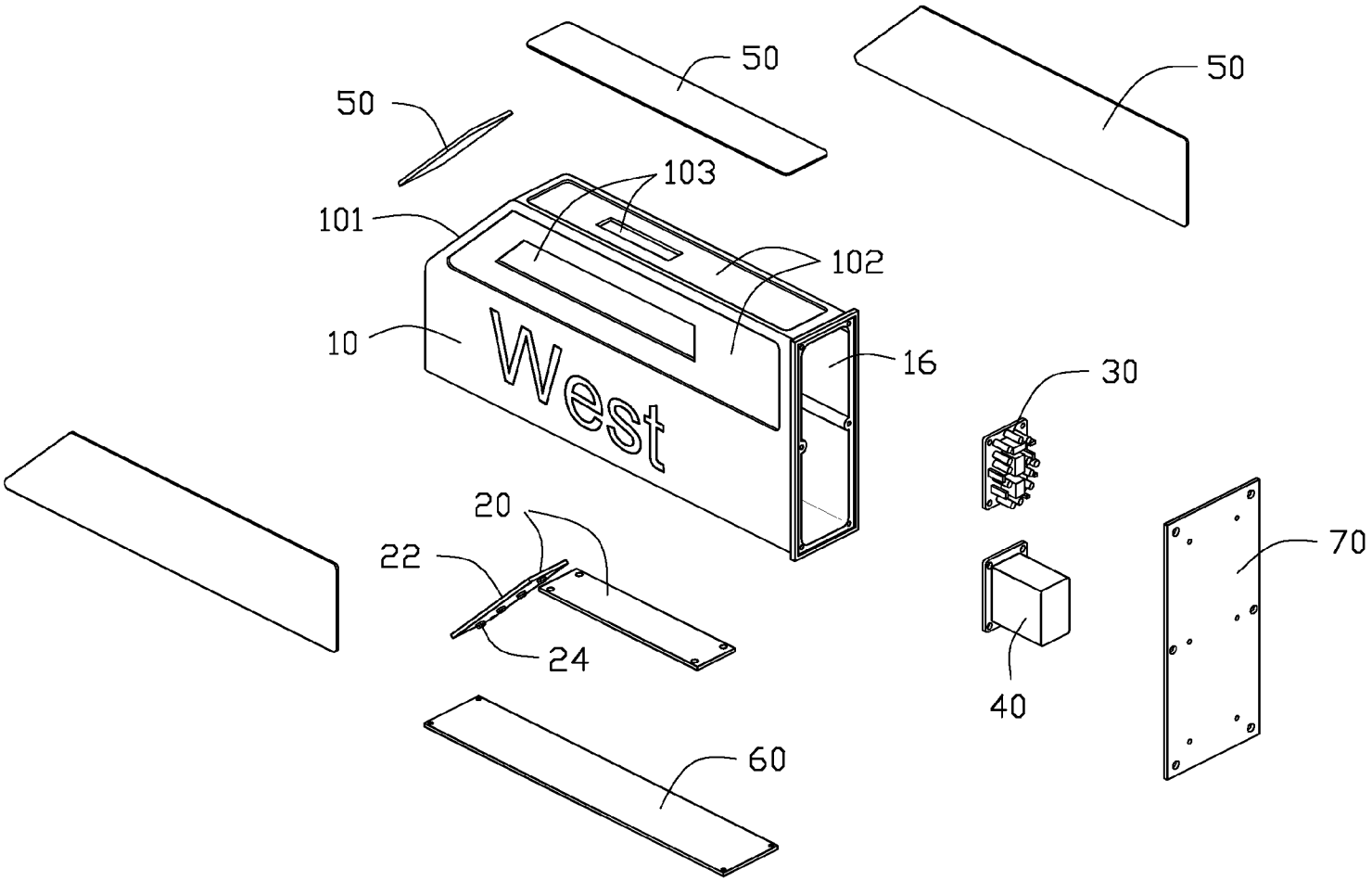
FIG. 3 is an exploded view of the LED indicator lamp of FIG. 2.
Figure 4:
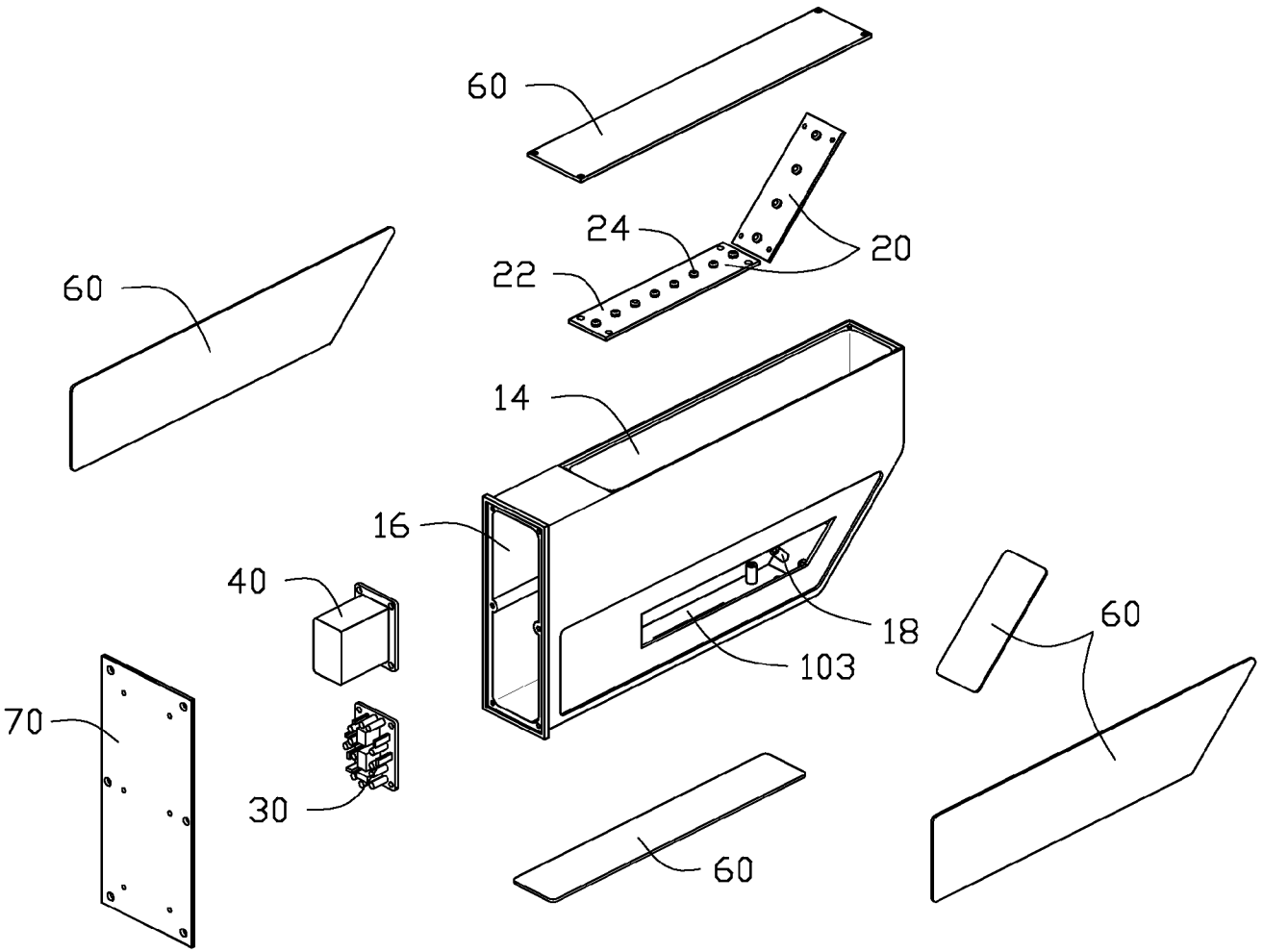
FIG. 4 is an inverted, exploded view of the LED indicator lamp of FIG. 2.

Referring to FIGS. 2 to 4, each LED indicator lamp 1 comprises a shell 10, two LED modules 20 mounted in the shell 10, a driving and controlling circuit board 30 received in the shell 10, a rechargeable battery 40 supplying the LED modules 20 with electrical power. A plurality of solar panels 50 are mounted on an outer surface of the shell 10 to capture sunlight and convert it to electrical energy, i.e., direct current (DC) power, for charging the rechargeable battery 40.

The shell 10 has a generally cuboid configuration with a top, outer corner thereof being cut away to define an inclined face 101 at the corresponding corner thereof. Due to an absence of the top, outer corner, the shell 10 looks like an arrow and is capable of showing a direction. In use, the shell 10 is formed with indicating words to give instructions to the motorists and tourists. To enable the indicating words on the shell 10 to be easily recognizable, the shell 10 is formed of transparent material, while the indicating words are formed with color. Alternatively, the shell 10 is formed with color, except the indicating words which are formed to be transparent.

A plurality of receiving recessions 102 are defined in a top surface, the inclined surface 101 and upper portions of two opposite sides of the shell 10 neighboring the inclined surface 101 and the top surface 101. The solar panels 50 are fixed in these receiving recessions 102. The solar panels 50 are respectively received in the receiving recessions 102 to surround an upper portion of the shell 10, for facilitating capturing of sunlight by the solar panels 50. The solar panels 50 fixed on the two opposite sides of the shell 10 are trapezium-shaped and occupy upper parts of the two opposite sides to thus leave lower parts of the two opposite sides available for placing the indicating words. An opening 103 is defined in each receiving recession 102 for an extension of wire leads (not show) to electrically connect the corresponding solar panel 50 to the rechargeable battery 40.

Figure 5:
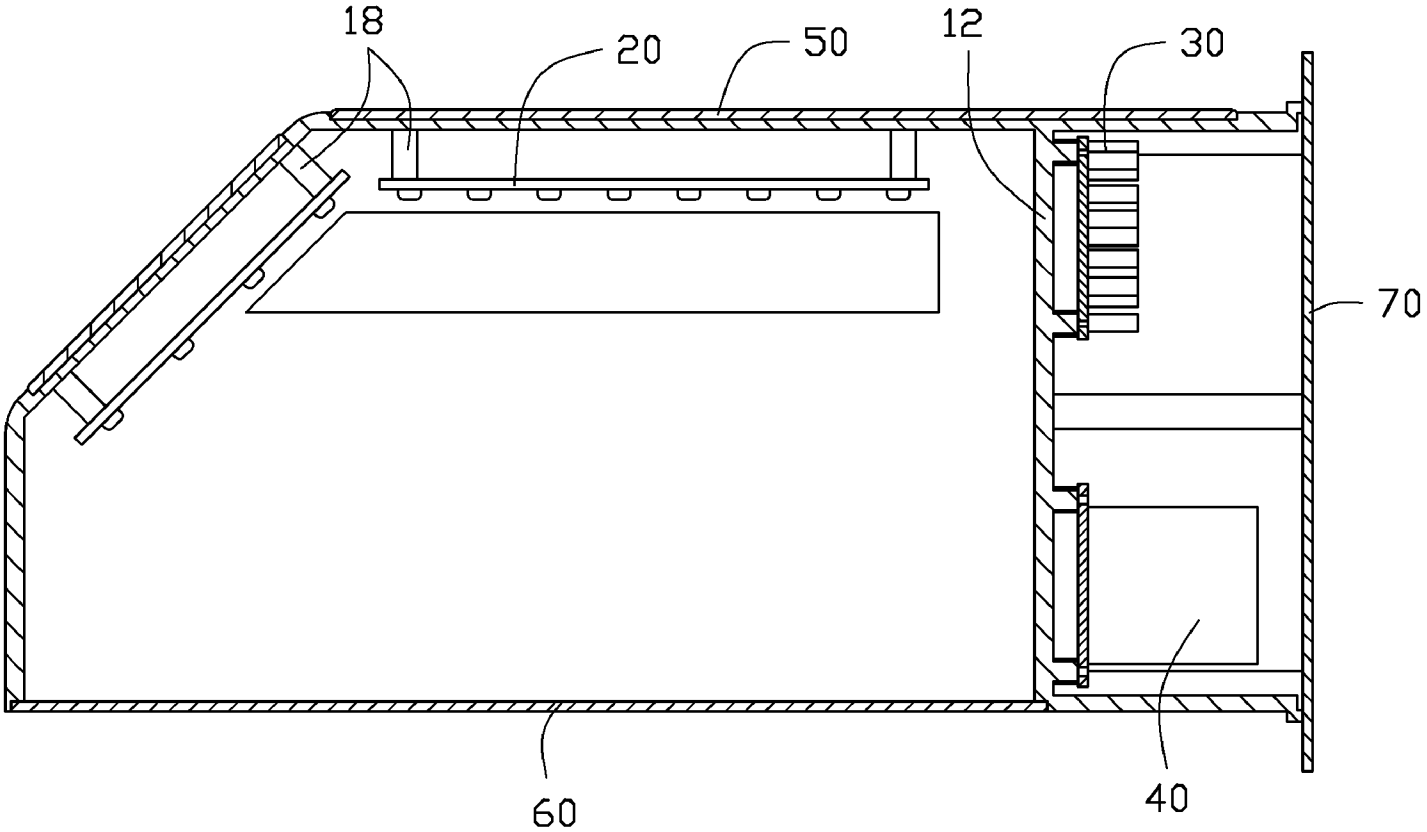
FIG. 5 is a cross-sectional view of the LED indicator lamp of FIG. 2, taken along line V-V thereof.

Also referring to FIG. 5, the shell 10 has a partitioning plate 12 therein, which is connected to an inner wall thereof to separate an inner room defined by the shell 10 into two parts with different sizes. The large part of the inner room of the shell 10 is located adjacent to the inclined surface 101 of the shell 10. The partitioning plate 12 is perpendicular to the top surface of the shell 10. A first opening 14 communicating with the large part of the inner room of the shell 10 is defined in a bottom of the shell 10. A second opening 16 communicating with the small part of the inner room of the shell 10 is defined in a rear side of the shell 10 opposite to the inclined surface 101. The shell 10 is provided with a bottom board 60 snugly received in the first opening 14 and a rear board 70 fixed on the rear side of the shell 10 and covering the second opening 16. In this embodiment, the openings 14, 16, the bottom board 60 and the rear board 70 are all rectangular, though, they are not limited to this shape and can have various shapes such as circular, triangular etc. in other embodiments.

The LED modules 20 are placed into the shell 10 from the first opening 14 of the shell 10 to lighten the shell 10, thereby highlighting the indicating words. In this embodiment, the two LED modules 20 are held at undersides of the top surface and the inclined surface 101 of the shell 10 and parallel to the undersides of the top surface and the inclined surface 101 respectively. A plurality of fixing posts 18 extend perpendicularly and inwardly from the top surface and the inclined surface 101 into the shell 10. The two LED modules 20 are secured at distal ends of the fixing posts 18 by mounting screws (not shown) which are extended through the LED modules 20 and screwed into the corresponding fixing posts 18. The two LED modules 20 each have an elongated printed circuit board 22 and a plurality of LED components 24 mounted on the printed circuit board 22 and facing the first opening 14 of the shell 10. An obtuse angle is defined between the two printed circuit boards 22.

The driving and controlling circuit board 30 and the rechargeable battery 40 are placed into the small part of the inner room of the shell 10 from the second opening 16 of the shell 10 and fixed to the partitioning plate 12.

In use of the LED indicator lamp 1, the rear board 70 is attached to the lamp pole 2 to hold the LED indicator lamp 1 directed to a desired direction in respect to the lamp pole 2. In the daytime, the solar panels 50 convert sunlight to electrical power to charge the rechargeable battery 40. In the night, the LED indicator lamp 1 is powered by the rechargeable battery 40; therefore, the LED indicator lamp 1 can be used in any remote area and does not require external electrical power.

In an alternative embodiment, the bottom board 60 can be made of transparent or translucent material to allow light generated by the LED modules 20 to transmit therethrough. Thus, the LED indicator lamp 1 can also function as a street lamp to provide a road or a street with illuminating light.

In a further alternative embodiment, the driving and controlling circuit board 30 has a photo sensor mounted thereon in a way to detect an ambient light condition and a controller receiving a signal from the photo sensor. The controller compares the signal received from the photo sensor and a data stored therein and sends an electronic signal to the driving and controlling circuit board 30 according the compared result. The electronic signal is used to control the LED components 24 of the LED modules 20 to emit a desired amount of light according to the ambient light condition.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A light-emitting diode indicator lamp comprising:

a shell having indicating words formed thereon, the shell and the indicating words having different hues;

at least a light-emitting diode module received in the shell to lighten the shell and highlight the indicating words;

a driving and controlling circuit board received in the shell to drive and control the at least a light-emitting diode module to lighten;

a rechargeable battery received in the shell to provide the at least a light-emitting diode module with electrical power; and a plurality of solar panels fixed on an outer surface of the shell to capture sunlight and convert the sunlight to electrical power to charge the rechargeable batter;

wherein a corner of the shell is formed with an inclined surface to make the shell have a shape of an arrowhead pointing toward a direction; and wherein the shell has a partitioning plate connected to an inner wall thereof to separate an inner room defined by the shell into a large part and a small part, and the large part of the inner room is adjacent to the inclined surface.

2. The light-emitting diode indicator lamp of claim 1, wherein the solar panels are fixed on a top surface and two opposite sides of the shell.

3. The light-emitting diode indicator lamp of claim 2, wherein the solar panels are fixed on two upper portions of the two opposite sides of the shell, and two lower portions of the two opposite sides of the shell have the indicating words thereon.

4. The light-emitting diode indicator lamp of claim 1, wherein one of the solar panels is attached on the inclined surface.

5. The light-emitting diode indicator lamp of claim 4, wherein the at least a light-emitting diode module comprises two light-emitting diode modules respectively parallel to a top surface and the inclined surface of the shell, and the two light-emitting diode modules are at an obtuse angle to each other.

6. The light-emitting diode indicator lamp of claim 1, wherein a first opening communicating the large part of the inner room is defined in a bottom of the shell.

7. The light-emitting diode indicator lamp of claim 6 further comprising a transparent bottom board received in the first opening.

8. The light-emitting diode indicator lamp of claim 6, wherein a second opening communicating the small part of the inner room is defined in one side of the shell opposite to the inclined surface.

9. The light-emitting diode indicator lamp of claim 8 further comprising a rear board fixed on the side of the shell and covering the second opening.

10. The light-emitting diode indicator lamp of claim 1, wherein the driving and controlling printed circuit board and the rechargeable battery are received in the small part of the inner room of the shell.

11. The light-emitting diode indicator lamp of claim 1, wherein the shell is transparent and the indicating words are with color.

12. The light-emitting diode indicator lamp of claim 1, wherein the shell is with color and the indicating words are transparent.

13. An LED A light-emitting diode indicator lamp assembly comprising:

a lamp pole; and a plurality of light-emitting diode indicator lamps fixed to different sides of the lamp pole, each light-emitting diode indicator lamp comprising:

a shell having indicating words formed thereon, the shell and the indicating words having different hues;

at least a light-emitting diode module received in the shell to lighten the shell and highlight the indicating words;

a driving and controlling circuit board received in the shell to drive and control the at least a light-emitting diode module to lighten;

a rechargeable battery received in the shell to provide the at least a light-emitting diode module with electrical power, and a plurality of solar panels fixed on an outer surface of the shell to capture sunlight and convert the sunlight to electrical power to charge the rechargeable battery;

wherein the shell has a partitioning plate connected to an inner wall thereof to separate an inner room defined by the shell into a large part and a small part.

14. The light-emitting diode indicator lamp of claim 13, wherein the solar panels are fixed on two upper portions of two opposite sides and a top surface of the shell, and two lower portions of the two opposite sides of the shell have the indicating words thereon.

15. The light-emitting diode indicator lamp of claim 13, wherein an inclined surface is formed on an outer corner the shell to make the shell have a shape of an arrowhead pointing toward an outward direction.

16. The light-emitting diode indicator lamp of claim 13, wherein the at least a light-emitting diode module comprises two light-emitting diode modules received in the large part of the inner room of the shell and at an obtuse angle to each other.

17. The light-emitting diode indicator lamp of claim 13, wherein the driving and controlling printed circuit board and the rechargeable battery are received in the small part of the inner room of the shell.

* * * * *